US008232727B1

(12) United States Patent
Mays

(10) Patent No.: US 8,232,727 B1
(45) Date of Patent: Jul. 31, 2012

(54) BALLAST CIRCUIT FOR A GAS-DISCHARGE LAMP HAVING A FILAMENT DRIVE CIRCUIT WITH MONOSTABLE CONTROL

(75) Inventor: Steve Mays, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 388 days.

(21) Appl. No.: 12/685,969

(22) Filed: Jan. 12, 2010

Related U.S. Application Data

(60) Provisional application No. 61/157,837, filed on Mar. 5, 2009.

(51) Int. Cl.
*H01J 13/46* (2006.01)

(52) U.S. Cl. ..... 315/49; 315/94; 315/274; 315/309; 315/247

(58) Field of Classification Search ..... 315/247, 315/46–50, 64–69, 94–107, 112–118, 274–279, 315/291, 307, 309
See application file for complete search history.

(56) References Cited

U.S. PATENT DOCUMENTS 5,144,205 A 9/1992 Motto et al.
5,175,470 A 12/1992 Garbowicz
5,583,399 A 12/1996 Rudolph
5,589,740 A 12/1996 Rudolph et al.
5,656,891 A 8/1997 Luger et al.
5,703,441 A 12/1997 Steigerwald et al.
5,854,538 A 12/1998 Krummel
5,973,455 A 10/1999 Mirskiy et al.
6,366,031 B2 4/2002 Klien
6,433,490 B2 8/2002 Koch et al.
6,972,531 B2 12/2005 Krummel
7,279,844 B2 10/2007 Winkel et al.

*Primary Examiner* — Tuyet Thi Vo

(74) *Attorney, Agent, or Firm* — Waddey & Patterson, P.C.; Mark J. Patterson

(57) ABSTRACT

An electronic ballast circuit includes a filament drive circuit that can adjust the pulse width of a pulsed heating signal in accordance with the lamp current to a gas-discharge lamp. A logic device, such as an SR flip-flop, is used to control a switch that is coupled to the primary winding of a filament drive transformer coupled to the lamp filaments. The logic device opens and closes the switch device to generate the pulses of the pulsed heating signal and thus controls the pulse width of the pulses. A clock signal triggers logic device to start a pulse while the end of the pulse is determined by a signal level across a resistor in series with the primary winding of filament drive transformer. Once this signal level is at or above a threshold level, logic device switches the switch device to end the pulse.

20 Claims, 3 Drawing Sheets

BALLAST CIRCUIT FOR A GAS-DISCHARGE LAMP HAVING A FILAMENT DRIVE CIRCUIT WITH MONOSTABLE CONTROL

CROSS-REFERENCES TO RELATED APPLICATIONS

This application claims benefit of the following provisional patent application which is hereby incorporated by reference: U.S. Patent Application No. 61/157,837, filed Mar. 5, 2009.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Electronic ballast circuits use filament drive circuits to provide a heating voltage to the filaments of a gas-discharge lamp and to ensure that the filaments are properly heated during the operation of the lamp. A filament drive circuit may generate a pulsed heating signal to maintain the filaments at the appropriate temperature. Some gas-discharge lamps require that the heating effect of the pulsed heating signal be adjusted in accordance with the lamp current. This is particularly true if the gas-discharge lamp is connected to a dimmable ballast circuit that adjusts the lamp current in accordance with a desired dimming level.

Ballast circuits may have an inverter that operates to convert a DC voltage into an AC voltage at the appropriate frequency for operating the gas-discharge lamp. To do this, inverter switch devices receive the DC voltage and are switched on and off at a switching frequency to generate a periodic signal. A control circuit coordinates the switching of the inverter switch devices using clock signals. This periodic signal is then filtered through a resonant circuit to create the appropriate AC voltage for powering the gas-discharge lamp. The problem with prior art filament drive circuits is that they either interfere with the operation of the inverter or they require a complicated coordination scheme with the clock signals to adjust the heating effect of the pulsed heating signal.

For example, prior art filament drive circuits may couple a filament drive resonant tank in parallel with the resonant circuit in the inverter. Adjusting the resonant frequency of the filament drive resonant tank adjusts the heating effect of the pulsed heating signal. Unfortunately, this also has the effect of adjusting the resonant frequency of the inverter's resonant circuit. Complicated and expensive circuitry is required to achieve the desired heating effect while maintaining the desired dimming level of the lamp.

Other prior art filament drive circuits use a clock signal to coordinate the generation of the pulses. Unfortunately, these circuits require a processor to determine the number of clock cycles associated with a desired pulse width for the pulsed heating signal and to count clock cycles during the generation of a pulse. A processor then implements a complicated digital counting scheme to time the start and end of the pulses which reduces the reliability of the circuit and increases its cost.

What is needed is a filament drive circuit for an electronic ballast that does not significantly affect the resonant circuit of the inverter and that does not require complicated counting schemes to provide the appropriate heating effect to the lamp filaments.

BRIEF SUMMARY OF THE INVENTION

This invention is directed to a ballast circuit that utilizes a filament drive circuit to control the heating effect of the pulsed heating signal on the filaments of a gas-discharge lamp. The ballast circuit does not require expensive electronic components and is capable of controlling the heating effect of the pulsed heating signal without a parallel resonant tank or complicated digital counting schemes.

The ballast circuit may include an inverter with inverter switch devices that convert a DC voltage into a periodic voltage signal. A resonant circuit filters the periodic voltage signal into the required AC voltage for powering the gas-discharge lamps.

A filament drive transformer may be utilized to couple a pulsed heating signal to heat the lamp filaments. The filament drive transformer has a primary winding magnetically coupled to secondary windings which receive the pulsed heating signal and are coupled to the lamp filaments. In one embodiment, a switch device is coupled to the primary winding of the transformer and is controlled by a logic device, which may be an SR flip-flop. The switch device is coupled so that current flows through the primary winding when the switch device is in a conducting state and is blocked when the switch device is in a non-conducting switch state.

The set terminal of the SR flip-flop receives a clock signal from the inverter. A timing pulse of the clock signal triggers the logic device to close the switch device and begin the transmission of a pulse. The reset terminal of the SR flip-flop is coupled to the output of a comparator that senses a voltage level across a resistor in series with the switch device. The voltage across the resistor in series with the switch device is proportional to the current through the primary winding. The voltage, against which the comparator compares the voltage across the resistor in series with the switch device, is preset so as to control the peak instantaneous current flowing through the primary winding, which will control the cycle by cycle energy transferred to the lamp filaments. When the voltage across the resistor in series with the switch device is at or above a threshold level, the comparator transmits an output signal to the reset terminal that causes the SR flip-flop to open the switch device and end the pulse. The filament drive circuit can adjust the threshold level and control the pulse width of the pulses on the pulsed heating signal. In this manner, the heating effect of the pulsed heating signal may be controlled without a parallel resonant circuit or complicated digital counting schemes.

DETAILED DESCRIPTION OF THE INVENTION

Figure 1:
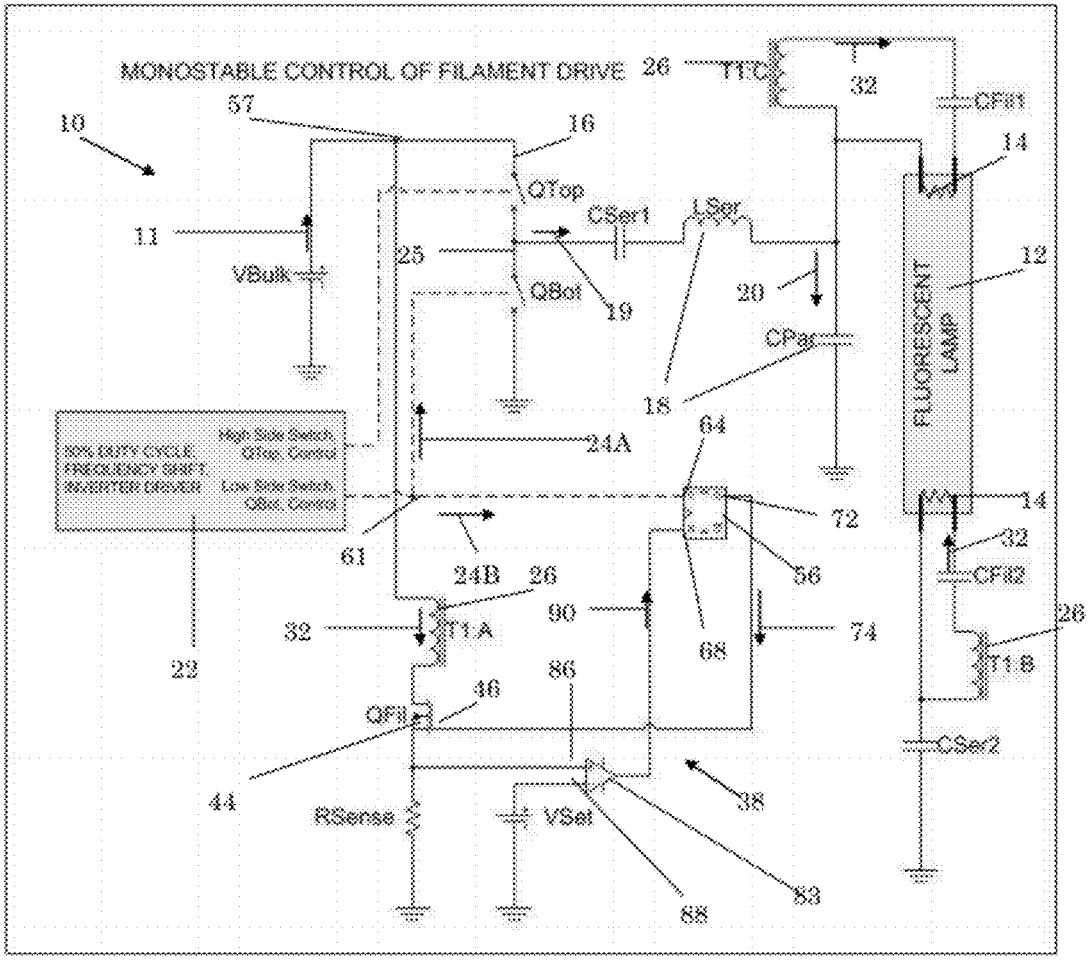
FIG. 1 is a schematic of one embodiment of a ballast circuit having a filament drive circuit in accordance with the invention.

Referring now to FIG. 1, an embodiment of a ballast circuit 10 for powering a gas-discharge lamp 12 in accordance with the invention is shown. The ballast circuit 10 has an inverter 16 that receives a DC voltage 11 from a DC voltage source, V_Bulk. The DC voltage source, V_Bulk, may be an independent DC source such as a battery or the like, an AC to DC converter (not shown) in ballast circuit 10 that converts an AC line signal from a power line into the DC voltage 11, or any other type of power source that generates a DC signal.

As is known in the art, inverter 16 utilizes inverter switch devices, QTop, QBot to generate a periodic signal 19 from the DC voltage 11. DC blocking capacitor, C_Ser1, blocks the DC components of the periodic signal 19. Resonant circuit 18 filters the periodic signal 19 to provide an AC voltage 20 at the appropriate frequency for powering the gas discharge lamp 12. In this particular embodiment, the resonant circuit 18 is a series resonant circuit and is coupled between the inverter switch devices QTop, QBot at terminal 25. Inverter switch devices, QTop, QBot are controlled by a control circuit 22 that generates clock signals 24A, 24B utilized to switch the inverter switch devices 24A, 24B at the appropriate frequency.

The above described circuit is an example of one inverter topology that may be utilized with the invention. There are many types of inverter topologies utilized to power one or more gas discharge lamps. While the invention does require an apparatus for converting a DC signal into an AC signal to power the gas-discharge lamp, the invention is not limited to any particular inverter topology as this feature is not critical to the invention.

Referring now to FIGS. 1 and 2, coupled to the inverter 16 is a filament heating transformer 26 having a primary winding T1:A and secondary windings, T1:B and T1:C. The primary winding T1:A is magnetically coupled to secondary windings, T1:B and T1:C to transmit a pulsed heating signal 32, that heats the lamp filaments 14 of the gas-discharge lamp 18. Pulsed heating signal 32 includes a series of pulses 34 which have a pulse width 36. This pulse width 36 determines the heating effect of the pulsed heating signal 32 on the lamp filaments 14.

As shown in the bottom graph of FIG. 2, the illustrated ballast circuit 10 generates pulses 34 having a rectangular shape. However, pulses 34 may have any shape desirable for heating the lamp filaments 14 of the gas-discharge lamp 18 including a saw-tooth, sinusoidal, or triangular shape. Pulsed heating signal 32 has a heating signal period 37 equal to the amount of time required by a cycle of the pulsed heating signal 32. Each pulse 34 has a starting time location 36A and an ending time location 36B and is present for a certain percentage of the heating signal period 37. This percentage is referred to as the duty-cycle of the pulsed heating signal 32. The greater the pulse width 36 the greater the duty cycle. Increasing the duty cycle thus increases the heating effect of the pulsed heating signal 32 and thus raises the temperature of the lamp filaments 14.

Figure 3:
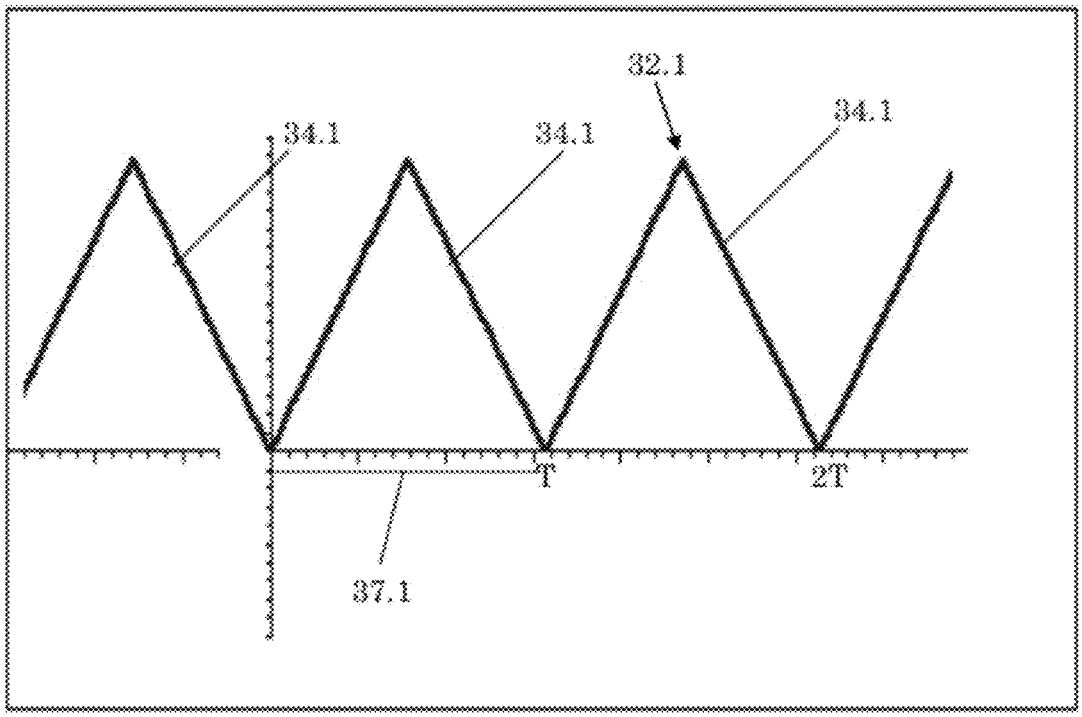
FIG. 3 is a graphical representation of another pulsed heating signal which may be generated by a filament drive circuit in accordance with the invention.

Other embodiments of the ballast circuit 10 may generate a pulsed heating signal 32 with a pulse shape that actually increases the heating effect of the pulsed heating signal 32 by decreasing the pulse width 36. For example, as shown in FIG. 3, the pulsed heating signal 32.1 may have a triangular shape, thereby forming a series of triangular pulses 34.1 that each represent the entire heating signal period 37.1. Assuming that the maximum amplitude each triangular pulse 34.1 remains the same, shortening the pulses 34.1 actually increases the energy being transmitted to the lamp filaments 14 and thereby increases the heating effect of the pulsed heating signal 32.1. It should be understood then that the shape of the pulses, or whether the heating effect is increased or decreased by either increasing or decreasing the pulse width, is not critical to the invention. Instead, the invention may be utilized to control the heating effect of any type of pulsed heating signal that has a heating effect which is at least partially determined by the duration of the pulses.

Figure 2A:
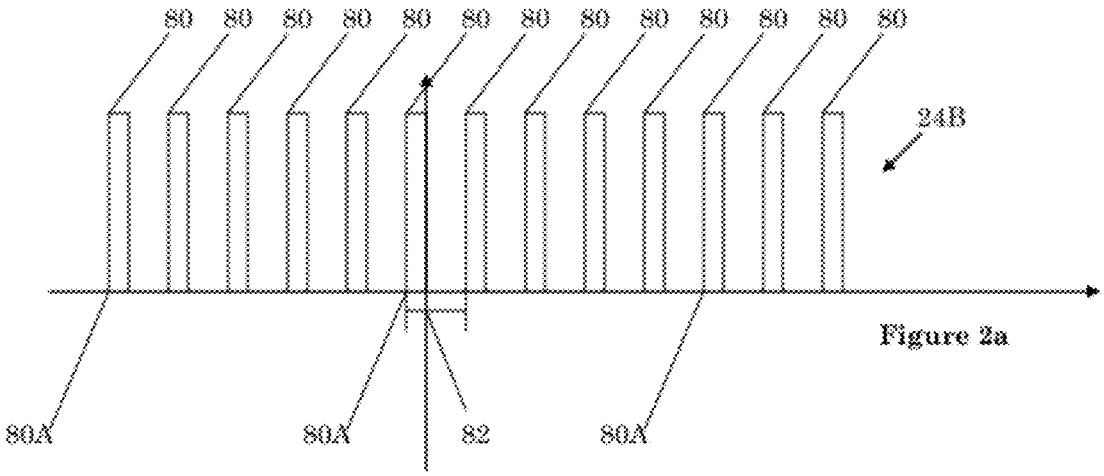
FIG. 2*a* is a graphical representation of a clock signal that controls the low side inverter switch device in the inverter of the ballast circuit shown in FIG. 1.
Figure 2B:
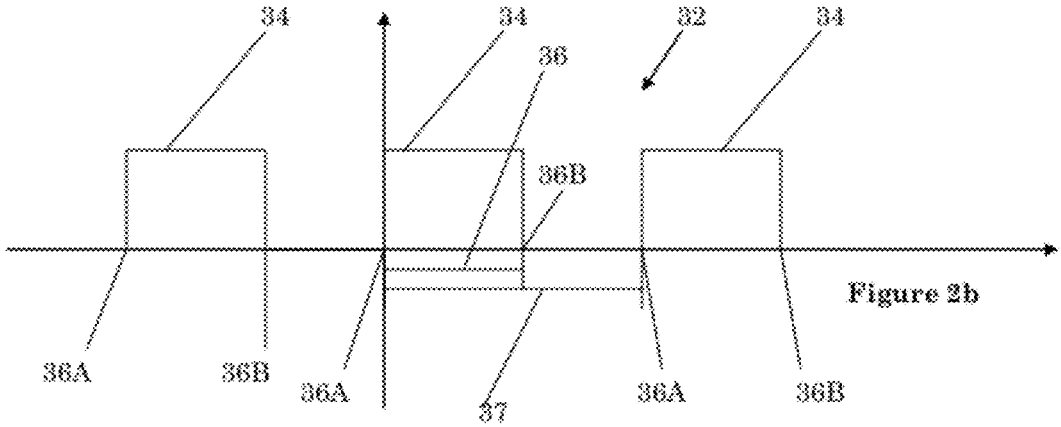
FIG. 2*b* is a graphical representation of a pulsed heating signal generated by the ballast circuit shown in FIG. 1.

Referring again to FIGS. 1 and 2, control circuit 22 determines the switching frequency of switches, QTop, QBot in the inverter 18. In the illustrated embodiment, the control circuit 22 is a 50% duty cycle, frequency shift inverter driver that transmits clock signals 24A and 24B to control the switch state of the inverter switch devices QTop, QBot. If the ballast 10 is being utilized to dim the lamp 18, clock signals 24A, 24B are used to set the switching frequency of the switch devices, QTop, QBot and thereby the dimming level. The graph of FIG. 2*a* is an illustration of clock signal 24B. Clock signal 24B transmits periodic timing pulses 80 during each clock cycle 82 to time the switching of low side inverter switch device, QBot.

A filament drive circuit 38 may utilize one of the clock signals 24A, 24B to generate the pulsed heating signal 32. Unlike prior art filament drive circuits, however, filament drive circuit 38 does not require the clock signal 24A, 24B to determine the pulse width 36. Thus, complicated digital counting schemes are not required to determine the starting and ending time locations 36A, 36B of the pulses 34.

In this embodiment, the filament drive circuit 38 receives the clock signal 24B which is also transmitted to the low side inverter switch device, QBot. As shown by the graphs in FIGS. 2*a* and 2*b*, the filament drive circuit 38 generates the pulsed heating signal 32 (FIG. 2*b*) by starting each pulse 34 of the pulsed heating signal 32 in response to the clock signal 24B (FIG. 2*a*) and ending each pulse 34 of the pulsed heating signal 32 when a signal level across a resistor in series with the switch device that corresponds to the current through T1:A is at or above a threshold level.

Switch device 44 may be coupled in series with primary winding T1:A to open and close a circuit path from a voltage source, which in this embodiment is DC voltage source, VBulk, to the primary winding T1:A. Pulses 34 are thus generated across the primary winding T1:A and coupled to secondary windings T1:B and T1:C whenever the switch device 44 is in a conducting switch state and ended whenever the switch device 44 is in a non-conducting switch state. In other embodiments, pulses 34 may be generated when the switch device 44 is in a non-conducting switch state, for example if the switch device 44 is connected in parallel to primary winding T1:A.

A logic device 56 may be utilized to control the conducting state of switch device 44. Logic device 56 receives the clock signal 24B at first logic device input terminal 64 and outputs a switch gate control signal 74 from output terminal 72. Switch device 44 receives the switch gate control signal 74 from output terminal 72 and switch gate control signal 74 controls the opening and the closing of the switch device 44.

In this embodiment, the switch gate control signal 74 is at a high signal level to close the switch device 44 and transmit a pulse 34 across the primary winding 28 and at a low signal level to open the switch device 44 and end the pulse 34.

To accomplish this, logic device 56 operates in accordance to a truth table such that the high signal levels and low signal levels received at input terminals 64, 68 generate a switch gate control signal 74 as required to start and end the pulses 34. In this embodiment, logic device 56 is a monostable SR flip-flop 56. SR flip-flop 56 outputs a switch gate control signal 74 having a stable signal level, which in this ballast circuit 10 is a low signal level and a nonstable signal level which is this ballast circuit 10 is a high signal level.

As is known in the art, SR flip-flop 56 may be constructed from NOT logic gates. SR flip-flop 56 stores and maintains switch gate control signal 74 in the low stable signal level so long as the input to the set terminal 64 and reset terminal 68 are low. When switch gate control signal 74 is at the low stable signal level, switch device 44 is in a non-conducting state and thus no pulse 34 is being transmitted on pulsed heating signal 32. Once the set terminal is set to high, the SR flip-flop 56 switches the switch gate control signal 74 to the high unstable signal level. Accordingly, switch device 44 switches into the conducting switch state thereby starting a pulse 34 on the pulsed heating signal 32.

The set terminal 64 of the logic device 56 may thus be coupled to first logic device input terminal 61 to receive the clock signal 24B that controls the low side inverter switch device QBot. SR flip-flop 56 responds to a timing pulse 80 by raising the switch gate control signal 74 from the low stable signal level to the high unstable signal level thereby closing switch device 44 and allowing current to flow from the voltage terminal 57 coupled to voltage source V_bulk to the primary winding, T1:A. This begins the transmission of a pulse 34. Of course, this does not necessarily mean the time location 80A of the timing pulse 80 and starting time location 36A of the pulse 34 on the pulsed heating signal 32 are the same or substantially the same. While the locations 36A and 80A may be the same, starting time location 36A is simply triggered in response to a timing pulse 80 and may be different from the time location 80A of timing pulse 80 according to the circuit components of the ballast circuit 10 as well as the requirements of the ballast circuit 10.

Reset terminal 68 of SR flip-flop receives a pulse termination signal 90 from comparator 84 that initially is at a low signal level. So long as the pulse termination signal 90 is at a low signal level, the switch gate control signal 74 is maintained high and the switch device 44 is maintained in a conducting switch state. As the pulse 34 is being transmitted across the primary winding, the current through primary winding T1:A is monitored utilizing the sensing resistor, R_sense. Ideally, the current level monitored by resistor R_sense is exactly equal to the current level through primary winding T1:A. In this embodiment, however, comparator 84 is an operational amplifier (op-amp). While the impedance of op-amps is very high, in practice it is not infinite and thus some current will leak through the comparator 84 as well as other components of the ballast circuit 10.

The voltage across sensing resistor, R_sense, is determined by the current through primary winding T1:A. Because the current in winding T1:A is related to the voltage level across primary winding T1:A, the voltage level across sensing resistor, R_sense, can be utilized to measure the voltage level across primary winding T1:A. Other embodiments of the ballast circuit 10 may measure other types of signal levels associated with primary winding T1:A, including current and power levels.

Comparator 84 receives the voltage level across the sensing resistor, R_sense, at a first comparator input terminal 86. Comparator 84 compares the voltage level across R_sense with the voltage level that is received at second comparator input terminal 88 from voltage source, V_set. Pulse termination signal 90 is maintained low while the voltage level at the first comparator input terminal 86 is below the voltage level at the second comparator input terminal 86 from voltage source, V_set. The ballast circuit 10 is configured so that the voltage level across the primary winding T1:A is at or above a threshold level when the voltage level at first comparator input terminal 86 is at or above the voltage level at the second comparator input terminal 88. Voltage source, V_set, thus generates a threshold signal at second comparator input terminal 88 that may be utilized to set the relevant threshold level across the primary winding T1:A Once the voltage level present at first comparator input terminal 86 is equal to or greater than the voltage level present at second comparator input terminal 88, the pulse termination signal 90 from comparator 84 is switched from a low signal level to a high signal level. Reset terminal 68 on the SR flip-flop receives the pulse termination signal 90 at the high signal level which triggers the SR flip-flop device 86 to switch the switch gate control signal 74 back to the low stable signal level. This places the switch device 44 in the non-conducting state and ends the pulse 34. Ending time locations 36B of pulses 34 are thereby determined by the threshold level set by voltage source, V_set, because this voltage level determines the voltage level across the primary winding T1:A that triggers the comparator 86 to generate pulse termination signal 90 at a high signal level. Consequently, the pulse width 36 of the pulses 34 is preset by voltage source, V_set, and the inductance of the primary winding T1:A.

While the starting location 34A of the pulses 34 is triggered in response to the clock signal 24B, the ending location 36B of the pulses 34 is determined independently of the clock signal 24B. This permits the pulse widths 36 of the pulses 34 to be determined by the filament drive circuit 38 without complicated digital counting schemes. It should be understood however that while this particular embodiment of the ballast circuit 10 utilizes an SR flip-flop 56 to start and end the pulses 34, other logic devices and flip-flops may be used with the invention which may produce truth tables that vary in accordance with the particular application. Other logic devices 56 are known to generate a switch gate control signal 74 at a high and low signal level depending on the signal level at one or more input terminals 64, 68. It is not important whether high signal levels or low signal levels cause switch gate control signal 86, 88 to operate at a high level or a low level, or that the switch device 44 be in a non-conducting or conducting state to start or end a pulse 34. Rather what is important about the logic device 56 is that it places the switch device 44 in the appropriate switch state for starting a pulse 34 in response to the clock signal 24B and that the pulse 34 is ended when a signal level associated with the primary winding T1:A is at or above a threshold level. In fact, clock signal 24B does not necessarily have to control the switching of inverter switch devices QTop, QBot but may be any clock signal having timing pulses associated with the switch frequency of the inverter switch devices, QTop, QBot.

In this manner, the heating effect of the pulsed heating signal 32 may be controlled by adjusting the voltage level from voltage source, V_set. During periods of low lamp current, the voltage level from voltage source, V_set, may be adjusted to change the pulse width 36 and increase the heating effect of the pulsed heating signal 32. This is particularly advantageous with dimmable ballast circuits 10 which are capable of continually adjusting the AC voltage 20 to the lamp 18.

Thus, although there have been described particular embodiments of the present invention of a new and useful Ballast Circuit for a Gas-Discharge Lamp Having a Filament Drive Circuit with Monostable Control it is not intended that such references be construed as limitations upon the scope of this invention except as set forth in the following claims.

What is claimed is:

1. A ballast circuit for heating a lamp filament of a gas-discharge lamp, comprising:

an inverter operable to generate an AC signal for powering the gas-discharge lamp, the inverter including a control circuit that generates a clock signal;

a primary winding;

a secondary winding for coupling to the lamp filament, the primary winding being magnetically coupled to the secondary winding to transmit a pulsed heating signal to the lamp filament; and a filament drive circuit coupled to the primary winding and including an input terminal for receiving the clock signal, the filament drive circuit being operable to generate the pulsed heating signal by starting each pulse of the pulsed heating signal in response to the clock signal and ending each pulse of the pulsed heating signal when a signal level corresponding to a current level in the primary winding is at or above a threshold level.

2. The ballast circuit of claim 1, wherein the inverter includes at least one inverter switch device for converting a DC signal into the AC signal, the control circuit being functional to operate the inverter switch device in accordance with the clock signal.

3. The ballast circuit of claim 1, wherein the pulse generation circuit further comprises a comparator having a first comparator input terminal for receiving a sensed signal associated with the signal level corresponding to the current level in the primary winding and a second comparator input terminal for receiving a threshold signal associated with the threshold level, the comparator being operable to generate a pulse termination signal when the signal level across the primary winding is at or above the threshold level.

4. The ballast circuit of claim 1, further comprising:

a voltage terminal for receiving a voltage signal;

the filament drive circuit including a switch device, the primary winding being coupled to the voltage terminal and the switch device such that closing the switch device transmits the voltage signal on the primary winding and opening the switch ends the transmission of the voltage signal whereby one of the pulses is generated by the filament drive circuit.

5. The ballast circuit of claim 1, wherein the pulse generation circuit further comprises:

a switch device coupled to the primary winding so that the primary winding starts to transmit one of the pulses to the secondary winding when the switch device is in a first switch state and ends the transmission of the one of the pulses when the switch device is in a second switch state; and a logic device having a first logic device input terminal to receive the clock signal and a second logic device input terminal for receiving a pulse termination signal, the logic device being operable to cause the switch device to operate in the first switch state in response to the clock signal and to cause the switch device to operate in the second switch state upon receiving the pulse termination signal.

6. The ballast circuit of claim 5, wherein the logic device comprises a flip-flop device.

7. The ballast circuit of claim 6, wherein the flip-flop device comprises an SR flip-flop device, the first logic device input terminal being a set terminal of the SR flip-flop device and the second logic device input terminal being a reset terminal of the SR flip-flop device.

8. The ballast of claim 5, further comprising:

the switch device including a switch gate input terminal for controlling the operation of switch device; and the logic device having an output terminal coupled to the switch gate input terminal, the logic device being operable to generate a switch gate control signal at a first switch control signal level for operating the switch device in the first switch state and at a second switch control signal level for operating the switch device in the second switch state.

9. The ballast circuit of claim 8, further comprising:

the clock signal including a periodic timing pulse during each clock cycle; and the logic device being operable to respond to the periodic timing pulses by changing the switch gate control signal from the second switch control signal level to the first switch control signal level.

10. A ballast circuit for heating a lamp filament of a gas-discharge lamp:

an inverter having at least one inverter switch device operable to convert a DC signal into an AC signal and a control circuit that transmits a clock signal to operate the inverter switch device;

an inductive electronic component that receives a pulsed heating signal;

a filament drive circuit coupled to the primary winding and including an input terminal for receiving the clock signal, the filament drive circuit being operable to generate the pulsed heating signal by starting each pulse of the pulsed heating signal in response to the clock signal and ending each pulse of the pulsed heating signal when a signal level corresponding to a current level in the primary winding is at or above a threshold level.

11. The ballast circuit of claim 10, wherein the control circuit being operable to adjust the threshold level thereby changing a pulse width of the pulses.

12. The ballast circuit of claim 10, wherein the inverter comprises a resonant circuit and the filament drive circuit operates independently of the resonant circuit.

13. The ballast circuit of claim 12, wherein the primary winding is not part of the resonant circuit.

14. A method of heating a lamp filament of a gas-discharge lamp:

converting a DC signal into an AC signal for powering the gas-discharge lamp by opening and closing an inverter switch in accordance with a clock signal;

generating a pulsed heating signal, the generation of the pulsed heating signal comprising:

starting a pulse of the pulsed heating signal in response to the clock signal;

sensing a signal level across a first winding;

ending the pulse of the pulsed heating signal when the signal level across the first winding is at or above a threshold level;

heating the lamp filament with the pulsed heating signal.

15. The method of claim 14, wherein starting a pulse of the pulsed heating signal in response to the clock signal further comprises detecting a timing pulse on the clock signal.

16. The method of claim 14, wherein heating the lamp filament further comprises transmitting the pulsed heating signal from the first winding to a second winding magnetically coupled to the first winding, the second winding being coupled to the lamp filament.

17. The method of claim 15, further comprising isolating the first and second windings from a resonant circuit in the inverter.

18. The method of claim 14, wherein starting a pulse of the pulsed heating signal in response to the clock signal further comprises changing the operation of a switch device from a non-conducting switch state to a conducting switch state.

19. The method of claim 18, wherein ending the pulse of the pulsed heating signal when the signal level across the first winding is at or above a threshold level further comprises changing the operation of the switch device from the conducting switch state to the non-conducting switch state.

20. The method of claim 19, wherein generating the pulsed heating signal further comprises changing the switch states of the switch device utilizing a flip-flop device.

* * * * *